US008823477B2

(12) United States Patent
Malanczyj et al.

(10) Patent No.: US 8,823,477 B2
(45) Date of Patent: Sep. 2, 2014

(54) SHIELDED MAGNETIC ATTACHMENT APPARATUS

(75) Inventors: Danilo Dmitro Malanczyj, Oshawa (CA); Jeffrey Nathan Mclarty, Bowmanville (CA); Thiago Ike Avila, Camden East (CA); Michael William James Sinclair, Toronto (CA)

(73) Assignee: They Innovate Inc., Bowmanville (CA)

( * ) Notice: Subject to any disclaimer, the term of this patent is extended or adjusted under 35 U.S.C. 154(b) by 44 days.

(21) Appl. No.: 13/529,893

(22) Filed: Jun. 21, 2012

(65) Prior Publication Data

US 2012/0326819 A1 Dec. 27, 2012

Related U.S. Application Data

(60) Provisional application No. 61/499,472, filed on Jun. 21, 2011.

(51) Int. Cl.
*H01F 7/04* (2006.01)

(52) U.S. Cl.
USPC ..... 335/295; 269/8; 335/285

(58) Field of Classification Search
USPC ..... 335/285–288, 295; 269/8
See application file for complete search history.

(56) References Cited

U.S. PATENT DOCUMENTS

| | | | | |
|---|---|---|---|---|
| 4,251,791 | A | 2/1981 | Yanagisawa et al. | |
| 4,419,644 | A | 12/1983 | Baermann | |
| 4,779,314 | A | 10/1988 | Aoki | |
| 5,347,733 | A | 9/1994 | Whittington | |
| 5,367,309 | A | 11/1994 | Tashjian | |
| 5,600,977 | A | 2/1997 | Piron | |
| 5,983,464 | A | 11/1999 | Bauer | |
| 6,182,336 | B1 | 2/2001 | Bauer | |
| 6,515,223 | B2 | 2/2003 | Tashjian | |
| 6,888,940 | B1 | 5/2005 | Deppen | |
| 6,964,361 | B2 | 11/2005 | Kathrein | |
| 7,012,495 | B2 * | 3/2006 | Underwood et al. | 335/288 |
| 7,163,152 | B2 | 1/2007 | Osborn et al. | |
| 7,374,142 | B2 | 5/2008 | Carnevali | |
| 7,640,639 | B2 | 1/2010 | de Bien | |
| 7,757,913 | B2 | 7/2010 | Fichera | |
| 7,772,948 | B2 * | 8/2010 | Grow et al. | 335/285 |
| 7,843,295 | B2 | 11/2010 | Fullerton et al. | |
| 2006/0262655 | A1 | 11/2006 | Persson | |
| 2007/0060224 | A1 | 3/2007 | Liu | |
| 2008/0023508 | A1 | 1/2008 | Harchol | |
| 2010/0171578 | A1 | 7/2010 | Fiedler | |
| 2010/0317418 | A1 | 12/2010 | Zanetti | |

* cited by examiner

*Primary Examiner* — Bernard Rojas
(74) *Attorney, Agent, or Firm* — Hill & Schumacher

(57) ABSTRACT

A shielded magnetic attachment apparatus is provided, having engaged and disengaged configurations, and comprising: at least one magnet; a first casing comprising ferromagnetic material attached to one side of the at least one magnet; a second casing comprising ferromagnetic material operably magnetically attachable to the at least one magnet; and a release mechanism attached to either the first or second casing for transitioning the shielded magnetic attachment apparatus from the engaged to the disengaged configuration; wherein the shielded magnetic attachment apparatus is in the engaged configuration when the at least one magnet provides a magnetic force which acts to keep the shielded magnetic attachment apparatus in the engaged configuration, and the shielded magnetic attachment apparatus is in the disengaged configuration when not in the engaged position.

39 Claims, 13 Drawing Sheets

SHIELDED MAGNETIC ATTACHMENT APPARATUS

CROSS REFERENCE TO RELATED PATENT APPLICATION

This patent application relates to U.S. Provisional Patent Application Ser. No. 61/499,472 filed on Jun. 21, 2011 entitled SHIELDED MAGNETIC ATTACHMENT APPARATUS which is incorporated herein by reference in its entirety.

FIELD OF THE INVENTION

This invention relates to shielded magnetic attachment apparatuses, and more specifically to shielded magnetic attachment apparatuses comprising release mechanisms.

BACKGROUND

As consumer electronics technology progresses, there is an ongoing shift towards more portable mobile devices. For instance, cell phones, smart phones, tablets, and portable music players are all examples of technologies resulting from this shift. As these devices become more and more common, the need for a convenient way of attaching them to and carrying them on a person becomes more apparent. This need is especially apparent for those who have clothing with no pockets, such as dresses, skirts, and some pairs of pants. However, there are a few design obstacles to providing an attachment device that performs satisfactorily in this regard.

U.S. Pat. No. 7,640,639 to de Bien discloses a quick connect coupling assembly that has a first and second component, and a locking assembly structured to retain the components in an attached orientation with one another. The locking assembly includes a plurality of locking elements each having a locking arm with a locking member mounted to a distal end, wherein the locking members are maintained in an outwardly extending orientation by a biasing mechanism. The biasing mechanism may comprise magnetic biasing elements attached to each oppositely disposed locking element, the magnetic biasing elements structured to create a repulsive magnetic force between one another. The quick connect coupling assembly also includes a release mechanism to permit the locking members to be temporarily disposed into a retracted orientation, thereby permitting the first and second components to be detached from one another.

U.S. Pat. No. 6,182,336 to Bauer discloses a magnetic fastener including manually separable male and female assemblies, the female assembly including a movable lock member freely slidably positioned thereon and a lock release button movably mounted thereto. The fastener also includes a male assembly including a magnetic member, the male assembly being engageable with the lock release button. The movable lock member has an opening formed therein within which a portion of the male assembly is positionable such that, in a locked position, the movable member is shiftable to a position in proximity with the magnetic member and, upon engagement of the release button with the male assembly, the movable member is shiftable to a position spaced from the magnetic member. A method of fastening the fastener is also described. The location of the magnetic member and movable metal lock member are capable of being switched such that the magnetic member is slidable in a direction towards the metal lock member which is fixed in position within the male assembly.

U.S. Pat. No. 5,983,464 to Bauer discloses a magnetic fastener of the type which finds particular utility as a closure for a handbag flap. It includes cooperating male and female assemblies. The female assembly, which includes a permanent magnet, is intended to be secured to the main body portion of the handbag or other article which will be using the magnetic fastener as a closure. Both the female and male assemblies include a ferromagnetic member, having a planar portion. The permanent magnet includes a central opening which is configured to receive a central projecting ferromagnetic portion of the male assembly. The permanent magnet is substantially enclosed by non-ferromagnetic material which preferably provides a substantial, preferably dual, layer of non-ferromagnetic insulation material over at least a major portion of the permanent magnet's peripheral wall surfaces. The non-ferromagnetic enclosure may include an outermost piece which is snap fit over the other previously assembled portions of the female assembly. The outermost surfaces of the enclosure may be formed of a material (such as molded plastic) which may be colored and/or otherwise decorated to provide aesthetics which are coordinated with respect to the handbag or other article to which the fastener is attached.

U.S. Pat. No. 6,888,940 to Deppen discloses a magnetic holder for cell phones particularly for use as a device to attach a cell phone to the dashboard of a car. There is a first portion that is intended to be attached to the dashboard. The magnetic holder is attached to the dashboard with an adhesive strip, a suction cup or a clip. In one embodiment the battery portion of a cell phone is attracted to the magnetic holder. In another embodiment there is provided an iron or steel plate that is attached to a cell phone with double sided tape. In all of these embodiments, the relatively weak strength of the magnet allows the user to merely pull the cell phone from the stationary magnetic holder, and there is nothing in the patent that shows a release mechanism to detach the cell phone from the magnetic holder. Whereby, if a person were to use the same relatively weak magnet to secure a cell phone to a moving person, there would be a much greater chance of the cell phone releasing accidentally causing damage.

Therefore, it would be advantageous to provide a device that overcomes the aforementioned difficulties.

SUMMARY OF THE INVENTION

A shielded magnetic attachment apparatus is provided, having engaged and disengaged configurations, and comprising: at least one magnet; a first casing comprising ferromagnetic material attached to one side of the at least one magnet; a second casing comprising ferromagnetic material operably magnetically attachable to the at least one magnet; and a release mechanism attached to either the first or second casing for transitioning the shielded magnetic attachment apparatus from the engaged to the disengaged configuration; wherein the shielded magnetic attachment apparatus is in the engaged configuration when the at least one magnet provides a magnetic force which acts to keep the shielded magnetic attachment apparatus in the engaged configuration, and the shielded magnetic attachment apparatus is in the disengaged configuration when not in the engaged position.

A further understanding of the functional and advantageous aspects of the disclosure can be realized by reference to the following detailed description and drawings.

BRIEF DESCRIPTION OF THE FIGURES

Embodiments will now be described, by way of example only, with reference to the drawings, in which.

DETAILED DESCRIPTION OF THE INVENTION

The systems described herein are directed, in general, to shielded magnetic attachment apparatuses. Although embodiments of the present invention are disclosed herein, the disclosed embodiments are merely exemplary and it should be understood that the invention relates to many alternative forms, including different shapes and sizes. Furthermore, the Figures are not drawn to scale and some features may be exaggerated or minimized to show details of particular features while related elements may have been eliminated to prevent obscuring novel aspects. Therefore, specific structural and functional details disclosed herein are not to be interpreted as limiting but merely as a basis for the claims and as a representative basis for enabling someone skilled in the art to employ the present invention in a variety of manners.

As used herein, the terms "comprises", "comprising", "includes" and "including" are to be construed as being inclusive and open ended, and not exclusive. Specifically, when used in this specification including claims, the terms "comprises", "comprising", "includes" and "including" and variations thereof mean the specified features, steps or components are included. These terms are not to be interpreted to exclude the presence of other features, steps or components.

As used herein, the terms "about" and "approximately", when used in conjunction with ranges of dimensions, compositions of mixtures or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

As used herein, the coordinating conjunction "and/or" is meant to be a selection between a logical disjunction and a logical conjunction of the adjacent words, phrases, or clauses. Specifically, the phrase "X and/or Y" is meant to be interpreted as "one or both of X and Y" wherein X and Y are any word, phrase, or clause.

As used herein, the term "screw" refers to any object having a continuous spiral protrusion or functionally equivalent set of protrusions extending outwardly from a surface thereon.

As used herein, the term "threaded bore" refers to any object having grooves complementary to or shaped to accept any continuous spiral protrusion or functionally equivalent set of protrusions extending outwardly from a surface of a screw.

As used herein, the term "low reluctance" refers to a relative magnetic permeability higher than 10.

As used herein, the term "substantially closed magnetic circuit" refers to a continuous or near continuous low reluctance path in space broken only by gaps which are small compared to the size of the magnetic circuit and which are not substantially air-filled gaps.

Figure 1:
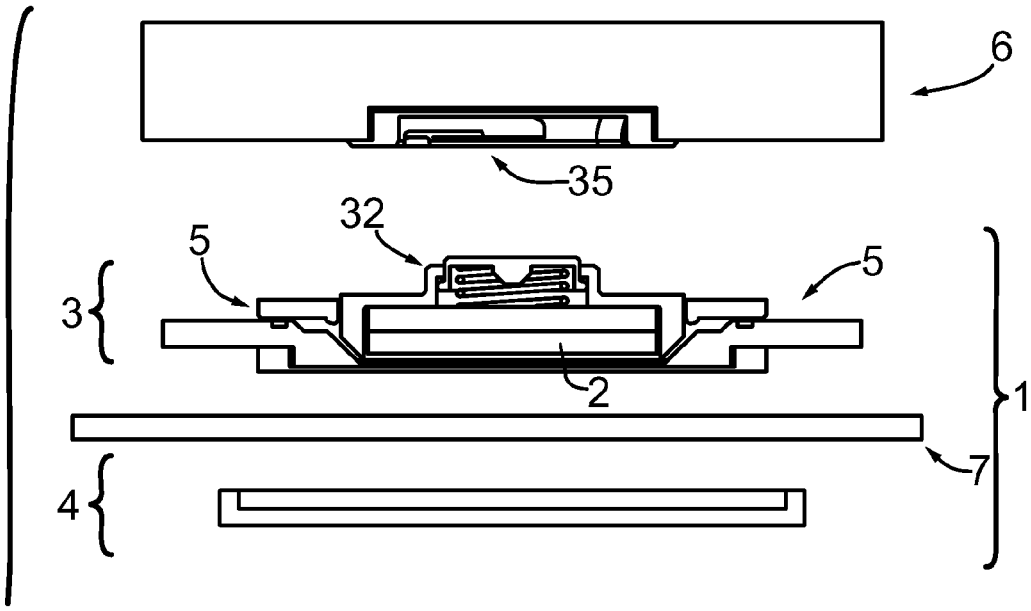
FIG. 1 is a side view of an embodiment of the shielded magnetic attachment apparatus, showing the first and second casings, the payload, and a piece of fabric as a receiving object.
Figure 2:
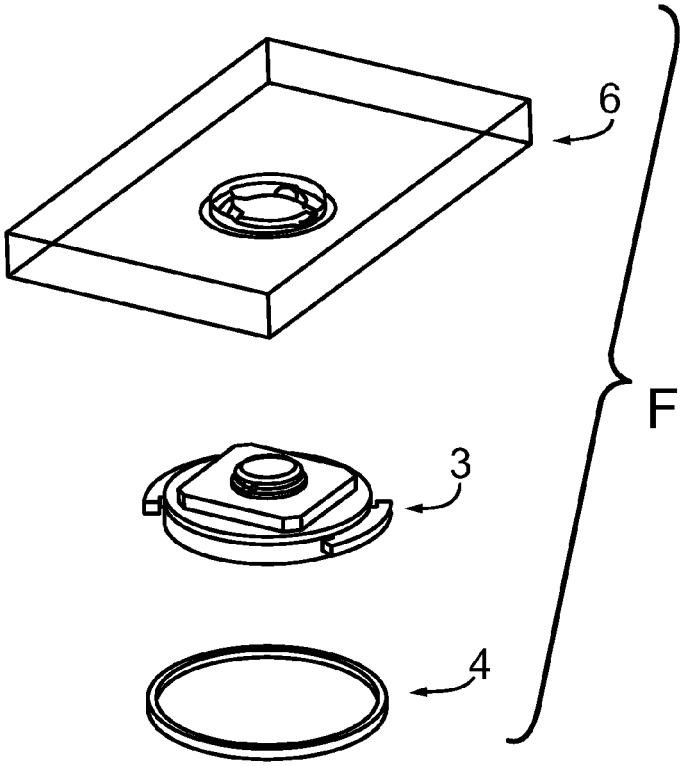
FIG. 2 is a perspective view of the embodiment shown in FIG. 1.

As demonstrated by the embodiment shown in FIGS. 1-2, the shielded magnetic attachment apparatus 1 having engaged and disengaged configurations, generally comprises: at least one magnet 2, a first casing 3 comprising ferromagnetic material attached to one side of the at least one magnet 2, a second casing 4 comprising ferromagnetic material operably magnetically attachable to the at least one magnet 2, and a release mechanism 5 attached to either the first or second casing 3, 4 for transitioning the shielded magnetic attachment apparatus 1 from the engaged to the disengaged configuration, wherein the shielded magnetic attachment apparatus 1 is in the engaged configuration when the at least one magnet 2 provides a force which acts to keep the shielded magnetic attachment apparatus 1 in the engaged configuration, and the shielded magnetic attachment apparatus 1 is in the disengaged configuration when not in the engaged position.

The shielded magnetic attachment apparatus 1 is a general purpose device for attaching a payload 6 to a receiving object 7. In an illustrative embodiment of the invention, the shielded magnetic attachment apparatus 1 may be used to attach consumer electronics or personal items to an item of clothing. In such a scenario, the receiving object 7 comprises the fabric or other material of the clothing or other object, while the payload 6 may be, for example, a phone, holster, case, tablet computer, MP3 player, GPS, wallet, purse, or any other suitable portable electronic or non-electronic device. However, it is to be readily appreciated that the shielded magnetic attachment apparatus 1 is not limited to use in this manner. For example, it will be appreciated that the receiving object 7 may comprise a refrigerator, desk, dashboard, purse or curtain.

Figure 3:
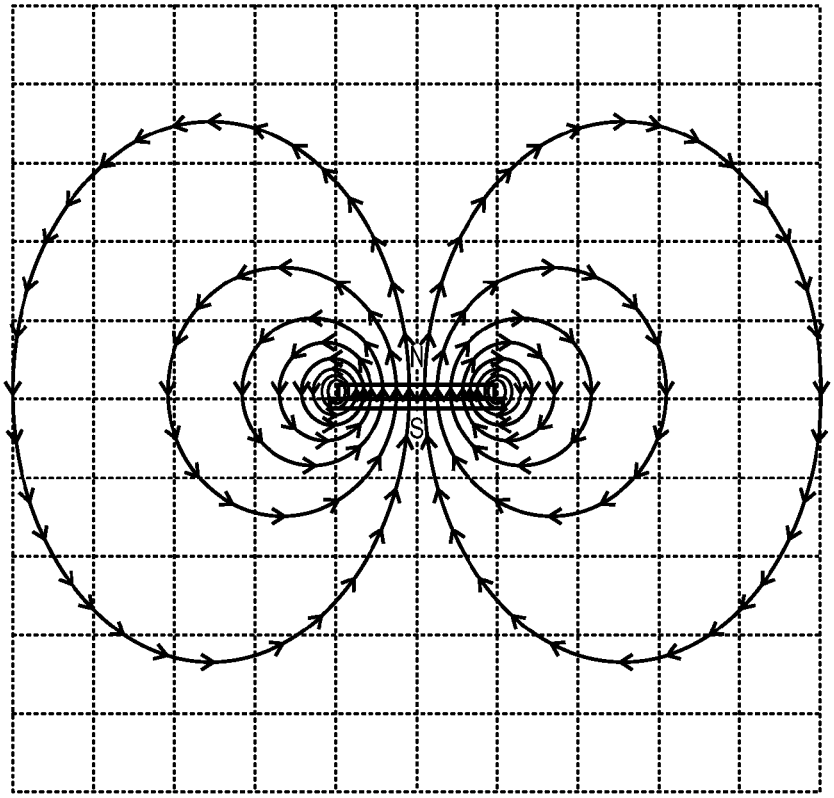
FIG. 3 is a diagram illustrating the general concept of operation of the shielded magnetic attachment apparatus, and shows the magnetic field lines around a simple magnet in free space without any shielding.
Figure 4:
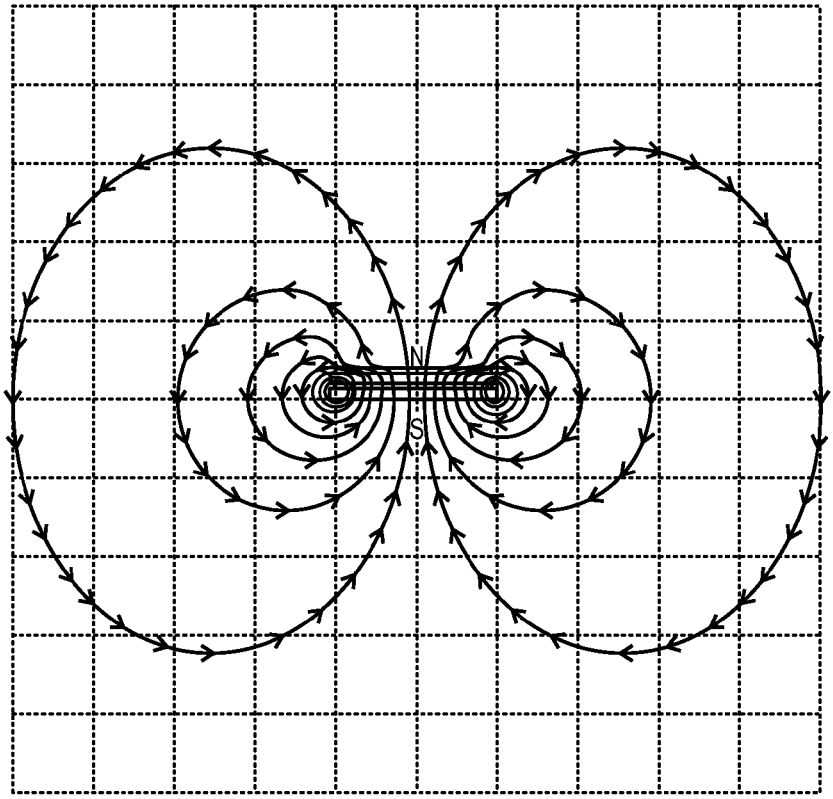
FIG. 4 is a diagram illustrating the change in the magnetic field lines with respect to FIG. 3 upon adding a first casing.
Figure 5:
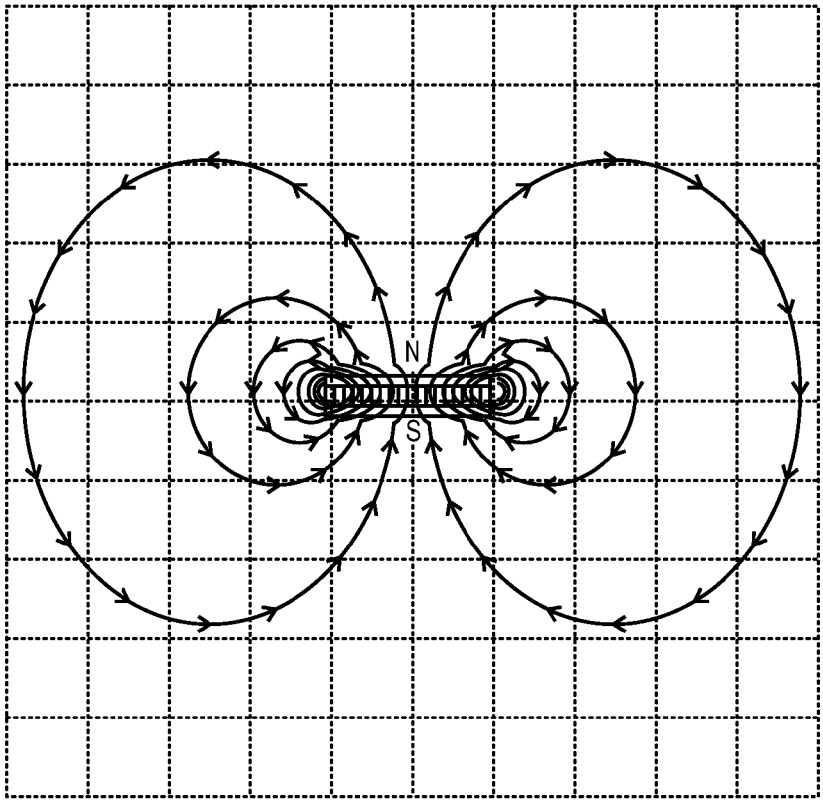
FIG. 5 is a diagram illustrating the change in the magnetic field lines with respect to FIG. 4 upon adding a second casing.
Figure 6:
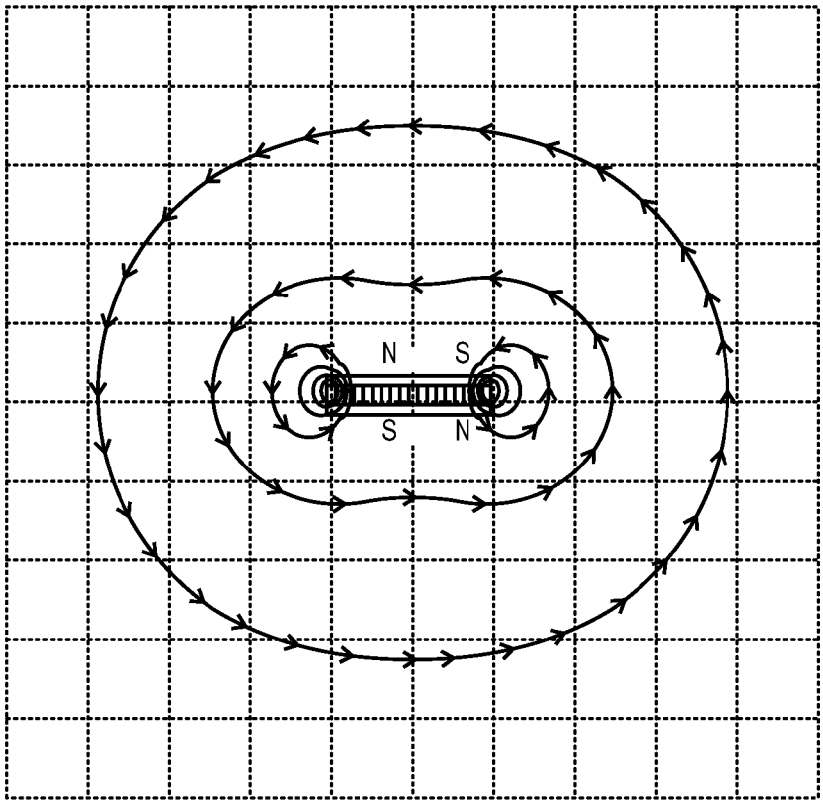
FIG. 6 is a diagram illustrating the change in the magnetic field lines with respect to FIG. 5 upon adding another magnet whose poles are arranged in an opposing manner to the first magnet.
Figure 7:
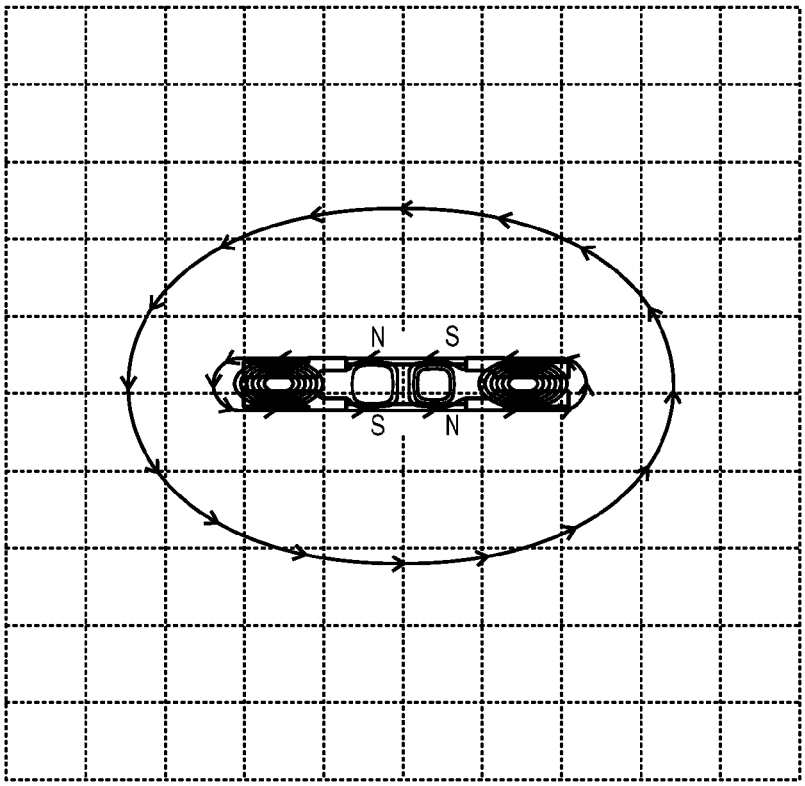
FIG. 7 is a diagram illustrating the change in the magnetic field lines with respect to FIG. 6 upon extending the first and second casings to extend beyond the magnets.
Figure 8:
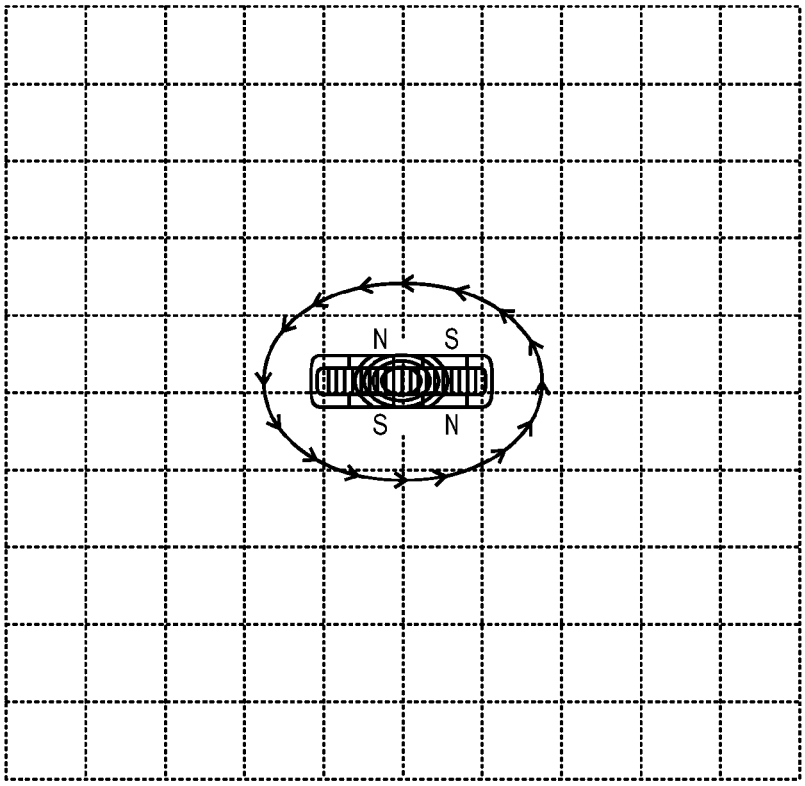
FIG. 8 is a diagram illustrating the change in the magnetic field lines with respect to FIG. 7 upon extending the first and second casings to substantially enclose the magnets.
Figure 9:
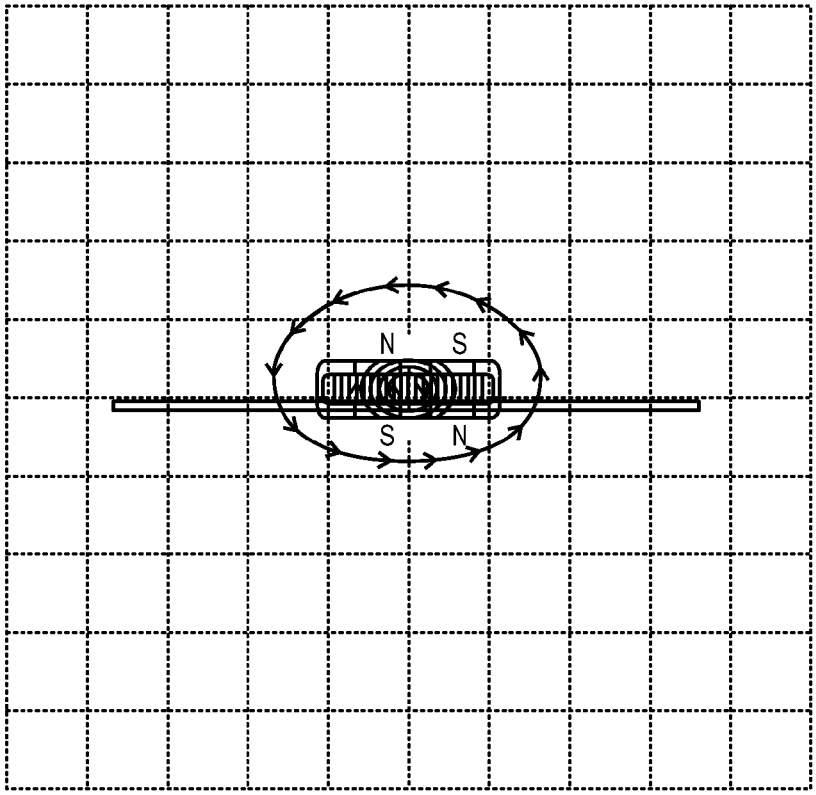
FIG. 9 is a diagram illustrating the change in the magnetic field lines with respect to FIG. 8 upon placing a sheet of fabric in between the first and second casings.
Figure 10:
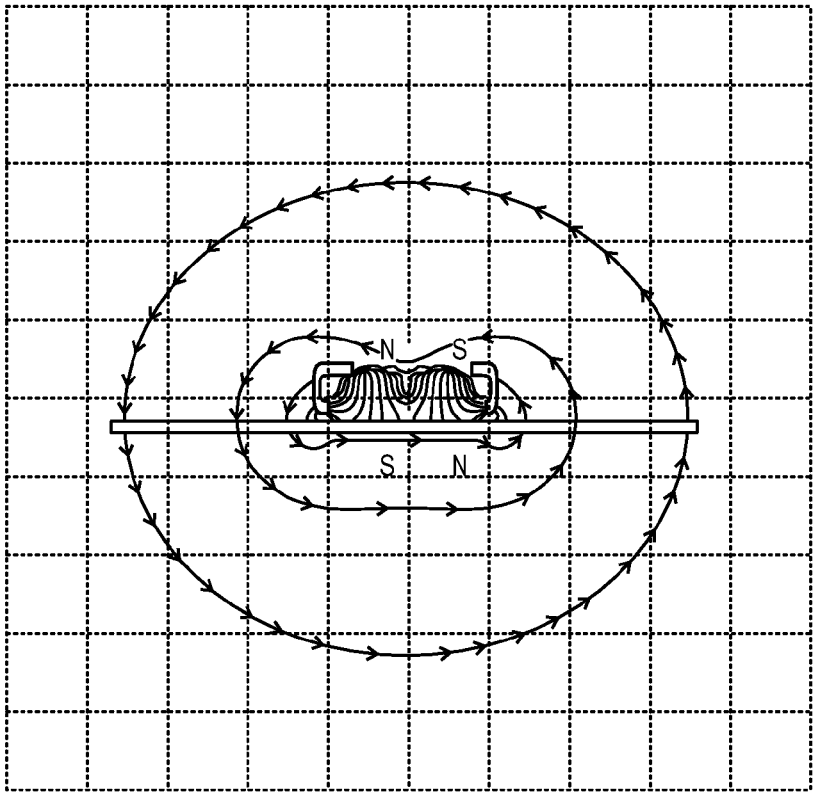
FIG. 10 is a diagram illustrating the change in the magnetic field lines with respect to FIG. 9 upon providing a separation between the first casing comprising the magnets and the second casing.

The general principle of operation of the disclosed devices is shown in FIGS. 3-10, which plot the magnetic field lines in the vicinity of various arrangements of the at least one magnet 2 and casing 3, 4. FIG. 3 shows the magnetic field lines around a simple magnet in free space without any shielding, a base case used for comparison purposes. FIGS. 4-5 show how the magnetic field reduces in strength exterior to the device upon addition of the first and second casing 3, 4, in this illustrative example a metal plate, above and below the magnet. FIG. 6 shows a further reduction in magnetic field strength exterior to the device by the replacement of the single magnet with two magnets arranged with their poles in opposite directions. FIGS. 7-8 illustrate the significant reduction of the magnetic field strength exterior to the magnetic device as a magnetic circuit is formed by the first and second casing 3, 4 above and below the magnets. Finally, FIGS. 9-10 illustrate the abstract concept of operation of an embodiment of the shielded magnetic attachment apparatus 1 with a receiving object 7, including the use of an air gap to reduce the magnetic force such that the at least one magnet 2 and second casing 4 can be separated from one another. These figures serve to illustrate the effectiveness of the shielded magnetic attachment apparatus 1 as disclosed herein; by shielding the at least one magnet 2 with the first and second casings 3, 4, the magnetic field strength exterior to the device is reduced significantly. Thereby, the shielded magnetic attachment apparatus 1 is rendered safe for use both with magnetic field-sensitive payloads 6, for example some electronics and wallets containing cards with magnetic strips, and with magnetic-field sensitive devices in the near vicinity, such as those in a nearby pocket or clipped to a belt. The combination of the low reluctance ferromagnetic shielding material in the first and second casings 3, 4, the release mechanism 5, and the high magnetic field strength produced by the at least one magnet 2 provides an apparatus which securely attaches a payload 6 to a receiving object 7, is easily detached by a user wishing to do so, and does not damage any magnetic field-sensitive devices in the near vicinity.

In an embodiment of the invention, the at least one magnet 2 may comprise one or combination of rare earth magnets, ferrite magnets, ceramic magnets, samarium cobalt magnets, neodymium iron boron magnets, and injection molded magnets.

The first casing 3 is generally attached to one side of the at least one magnet 2, and comprises ferromagnetic material. The second casing 4 generally comprises ferromagnetic material and is operably magnetically attachable to the at least one magnet 2. In an embodiment of the invention, the first casing 3 is attached to the at least one magnet 2 such that when the shielded magnetic attachment apparatus 1 is in the engaged configuration, the ferromagnetic material in the first and second casings 3, 4 form a substantially closed magnetic circuit around said at least one magnet 2. In another embodiment, the first casing 3 is attached to the at least one magnet 2 such that when the shielded magnetic attachment apparatus 1 is in the engaged configuration, the ferromagnetic material in the first and second casings 3, 4 form a substantially closed chamber around said at least one magnet 2. In a further embodiment, the ferromagnetic material comprising the first and second casings 3, 4 is one or combination of mu metal, steel, nickel, ferrite, electrical steel, permalloy, and iron. In a further embodiment, the ferromagnetic material comprising the first and second casings 3, 4 is an 80% nickel-20% iron alloy. In a further embodiment, the ferromagnetic material comprising the first and second casings 3, 4 may be layered such that the magnetic field strength exterior to the device is reduced more than if there were just one layer. It will be appreciated that in embodiments of the invention, the first and second casings 3, 4 need not be made entirely of ferromagnetic material and may comprise, for example but not limited to non-ferromagnetic paints, coatings, finishes, housings or components. For example, the use of plastic components in some embodiments of the present invention may provide a means to lower the weight and manufacturing cost of the shielded magnetic attachment apparatus 1.

The release mechanism 5 reduces the magnetic force caused by the at least one magnet 2 when the shielded magnetic attachment apparatus 1 is in the engaged configuration, allowing it to transition to the disengaged configuration. The release mechanism 5 may reduce this magnetic force for instance by increasing the distance between the at least one magnet 2 and second casing 4, by changing the physical arrangement of the at least one magnet 2, by introducing a primary air gap 24 within the first casing 3, or by providing a low reluctance path blocking the second casing 4 from the at least one magnet 2. Further, the release mechanism 5 may be biased to return to a rest position upon the removal of all user-applied torques and forces. This bias may be provided by many different mechanisms, including but not limited to springs or additional magnetic components.

Figure 11A:
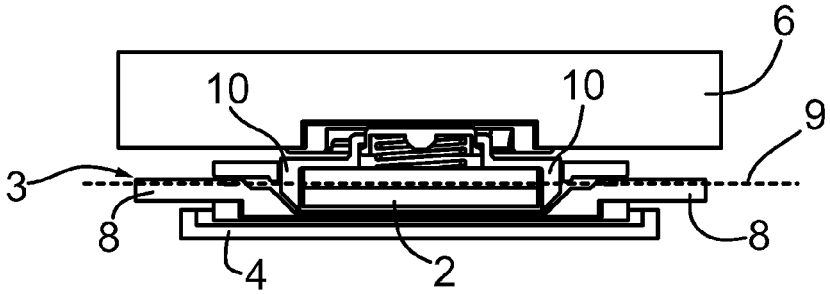
FIG. 11 is an embodiment of the release mechanism comprising two buttons and a force transfer mechanism, and shows the operation of the release mechanism upon a pushing force being applied to the buttons.
Figure 11B:
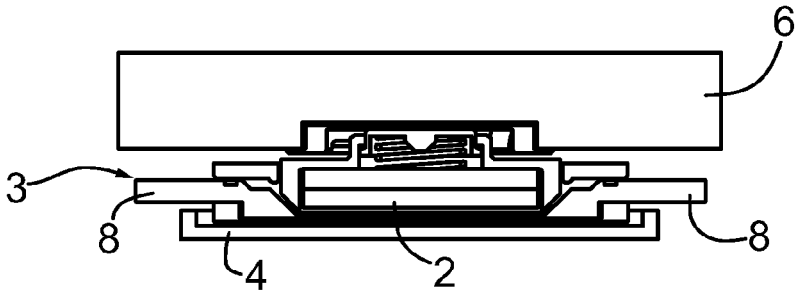

In one embodiment, the release mechanism 5 comprises at least one button 8 translatable along a push axis 9 and capable of transferring a force applied along the push axis 9, and a force transfer mechanism 10 for transferring the force applied along the push axis 9 to the magnet 2 in a direction away from the second casing 4. As shown in FIG. 11, one embodiment of this release mechanism 5 comprises at least one button 8 comprising an angled surface, and a force transfer mechanism 10 comprising a corresponding angled surface located on the first casing 3 and operably attached to the magnet 2. The corresponding angled surface is in contact with the angled surface such that, when the button 8 is pressed, the two angled surfaces slide with respect to one another and the magnet 2 is pushed away from the second casing 4. Thereby, an air gap between the magnet 2 and the second casing 4 is introduced and the magnetic force is reduced therebetween. It will be appreciated that the force transfer mechanism 10 depicted in the figures is exemplary and non-limiting, as many other transfer mechanism 10 are possible for use in this embodiment. For example, a rack and pinion may be used to transfer the linear button force to a rotational levering action to provide the air gap, or two repulsing magnets may be brought into alignment by the at least one button 8.

Figure 12A:
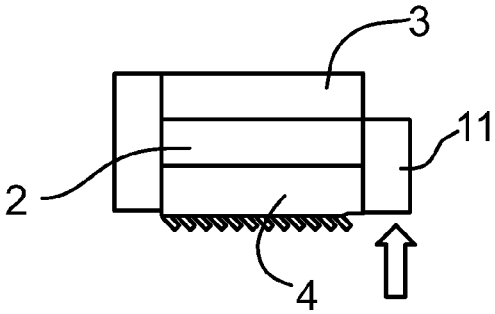
FIG. 12 is an embodiment of the release mechanism comprising a translatable gate, and shows the operation of the translatable gate to allow sliding motions of the first casing with respect to the second casing.
Figure 12B:
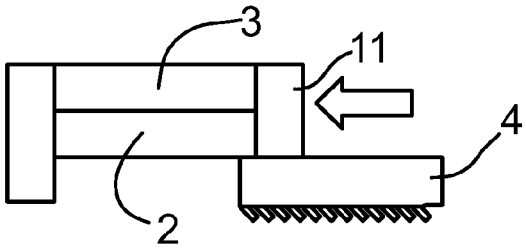

In another embodiment, the release mechanism 5 has a closed position in which it prevents sliding motions of the first casing 3 with respect to the second casing 4 when the shielded magnetic attachment apparatus 1 is in the engaged configuration and which, when opened, allows such motions. When the second casing 4 is operably magnetically attached to the magnet 2, sliding motions provide an easier way to separate the second casing 4 and the magnet 2 than pulling them apart. One such embodiment is illustrated in FIG. 12 and comprises a translatable gate 11 attached to the first casing 3, having an open and closed position and being movable between them, wherein the gate 11 is configured to prevent sliding motions of the first casing 3 with respect to the second casing 4 when the shielded magnetic attachment apparatus 1 is in the engaged configuration and the gate 11 is in the closed position. The gate 11 may be movable between its open and closed position for instance with a sliding action as shown in FIG. 12, and further the gate 11 may be biased and thus return to its normally closed position when no user-applied force is applied to the gate 11.

Figure 13:
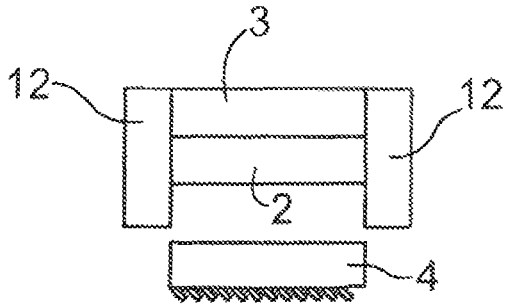
FIG. 13 is an embodiment wherein the first casing comprises a stop which prevents sliding motions of the first casing with respect to the second casing.
Figure 14:
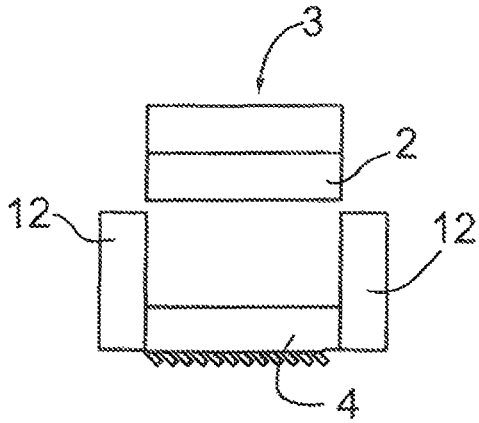
FIG. 14 is an embodiment wherein the second casing comprises a stop which prevents sliding motions of the first casing with respect to the second casing.

In a further embodiment, as shown in FIGS. 13-14, either the first or second casing 3, 4 comprises at least one stop 12 which prevents sliding motions of the first casing 3 with respect to the second casing 4 when the shielded magnetic attachment apparatus 1 is in the engaged configuration.

Figure 15A:
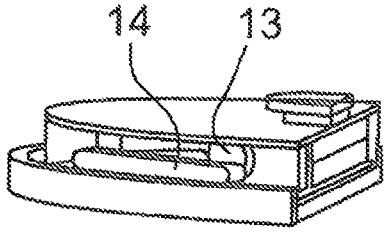
FIG. 15 is an embodiment wherein the release mechanism comprises a rotatable oval cam, and shows how the rotation of the cam increases the distance between the magnet and the second casing due to its shape.
Figure 15B:
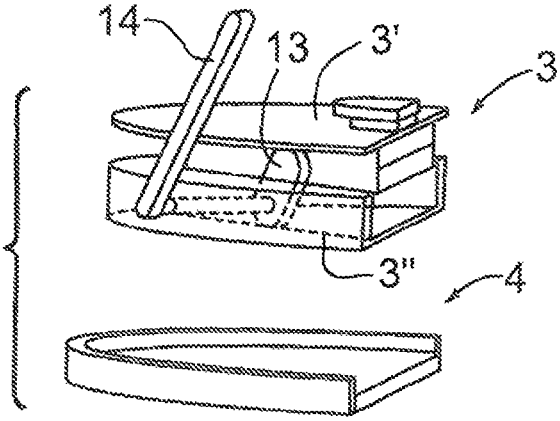

In another embodiment, the release mechanism 5 comprises a rotatable cam 13. Upon rotation of the cam 13, due to its shape it imparts a force which increases the distance between the magnet 2 and the second casing 4. It will be appreciated that the cam 13 may act directly through contact with the first casing 3, the second casing 4, or a combination of the first and second casings 3, 4. For example, in the embodiment shown in FIG. 15, the cam 13 acts directly solely upon the first casing 3, that is to say, the cam 13 separates two portions namely first portion 3' and second portion 3" of the first casing 3 thus increasing the distance between the magnet 2 and the second casing 4. The second portion 3" of the first casino 3 is non-ferromagnetic. The cam 13 could alternatively act directly between the first and second casings 3, 4, or act entirely within the second casing 4 alone in a corresponding manner to that shown in FIG. 15. In addition, it will be understood that the cam 13 may be of any noncircular shape having different lengths along different dimensions in the plane of its rotation; for example, in the embodiment shown in FIG. 15, the cam 13 comprises a rounded oblong plate. Further, the cam 13 may be actuated in any suitable manner known to those skilled in the art. For example, in the embodiment shown in FIG. 15, a lever 14 is affixed to the cam 13 such that rotation of the lever 14 causes a corresponding rotation of the cam 13. The cam 13 may optionally be biased such that it returns to a rest state when no user-applied torque is applied to the cam 13.

Figure 16A:
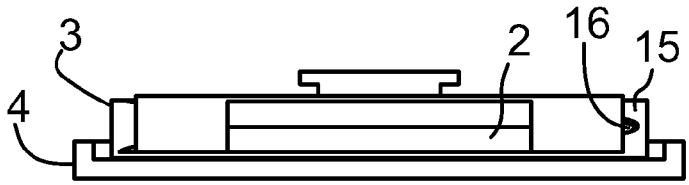
FIG. 16 is an embodiment wherein the release mechanism comprises a threaded bore and screw, wherein the screw is disposed on a first portion of the first casing and the threaded bore on a second portion of the first casing, and shows the operation of the screw in the threaded bore.
Figure 16B:
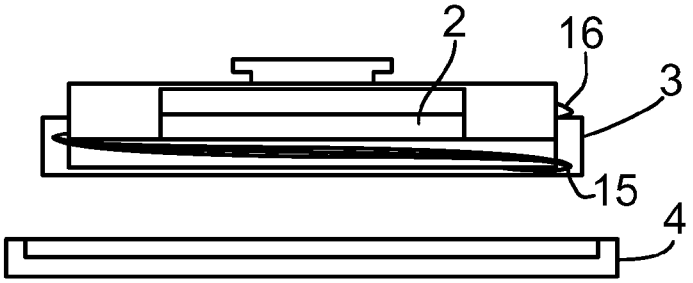

In another embodiment, the release mechanism 5 comprises a threaded bore 15 and screw 16. As shown in FIG. 16, the screw 16 may be disposed on a first portion of the first casing 3 and the threaded bore 15 on a second portion of the first casing 3, wherein the operation of the screw 16 in the threaded bore 15 causes the distance between the magnet 2 and second casing 4 to increase. It will be understood that the screw 16 and threaded bore 15 may both be formed within the first casing 3, second casing 4, or one of each may be formed in each of the first and second casings 3, 4. Further, while FIG. 16 illustrates a device in which the screw 16 is operable by a user while the threaded bore 15 remains fixed, equivalently an embodiment of the invention may comprise an operable threaded bore 15 with a fixed screw 16. One or both of the screw 16 and the threaded bore 15 may optionally be biased and thus return to a rest state when no user-applied torque is applied to the screw 16 or the threaded bore 15.

Figure 17:
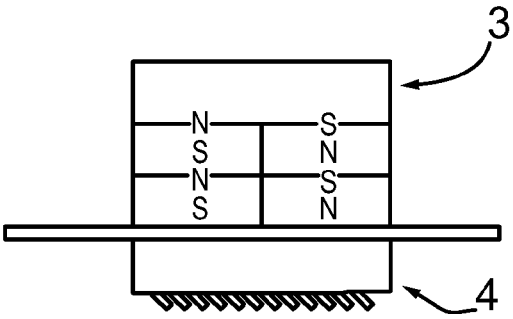
FIG. 17 is a diagram of the abstract concept of operation of embodiments of the release mechanism wherein in the engaged configuration the magnets are arranged such that the magnetic fields constructively interfere, and to transition to the disengaged configuration they are arranged such that the magnetic fields created destructively interfere, and shows the magnets constructively interfering.
Figure 18:
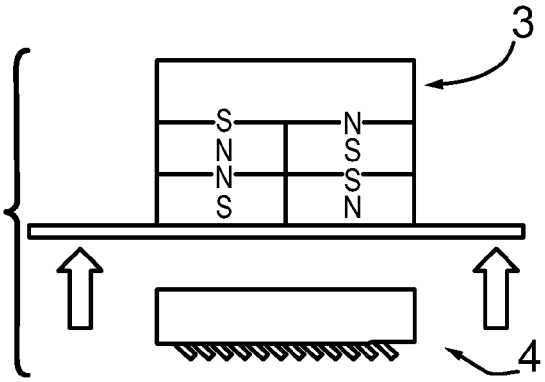
FIG. 18 shows the transition to the disengaged configuration in the embodiment shown in FIG. 17 by arranging the magnets to destructively interfere.
Figure 19:
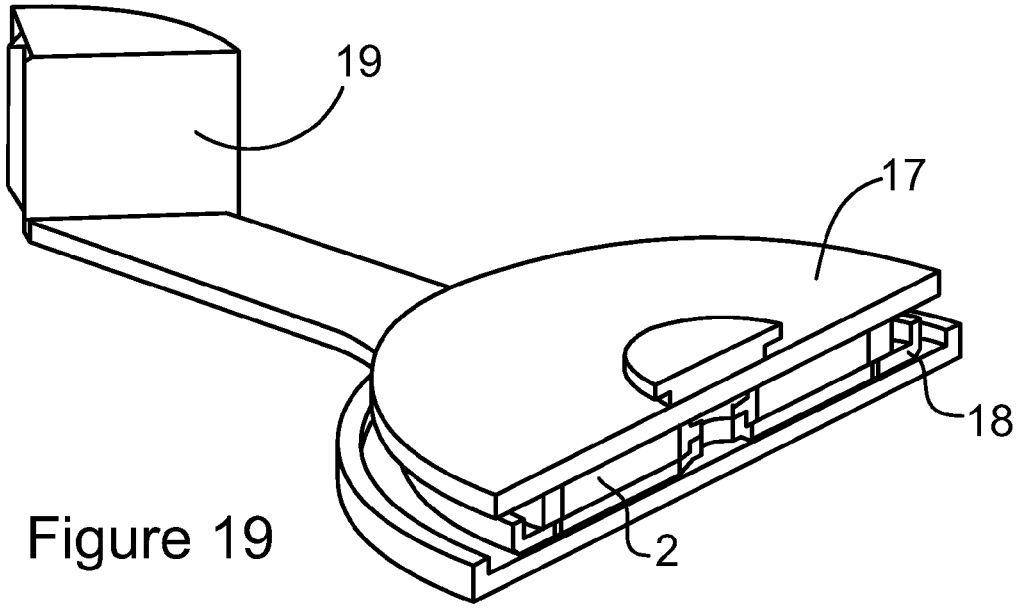
FIG. 19 is an instance of the release mechanism following the concept shown in FIGS. 17-18 wherein release mechanism comprises a first and second rotatable housing and the physical rearrangement of the magnets is performed by actuating a lever, and shows the magnets constructively interfering with the shielded magnetic attachment apparatus in the engaged configuration.
Figure 20:
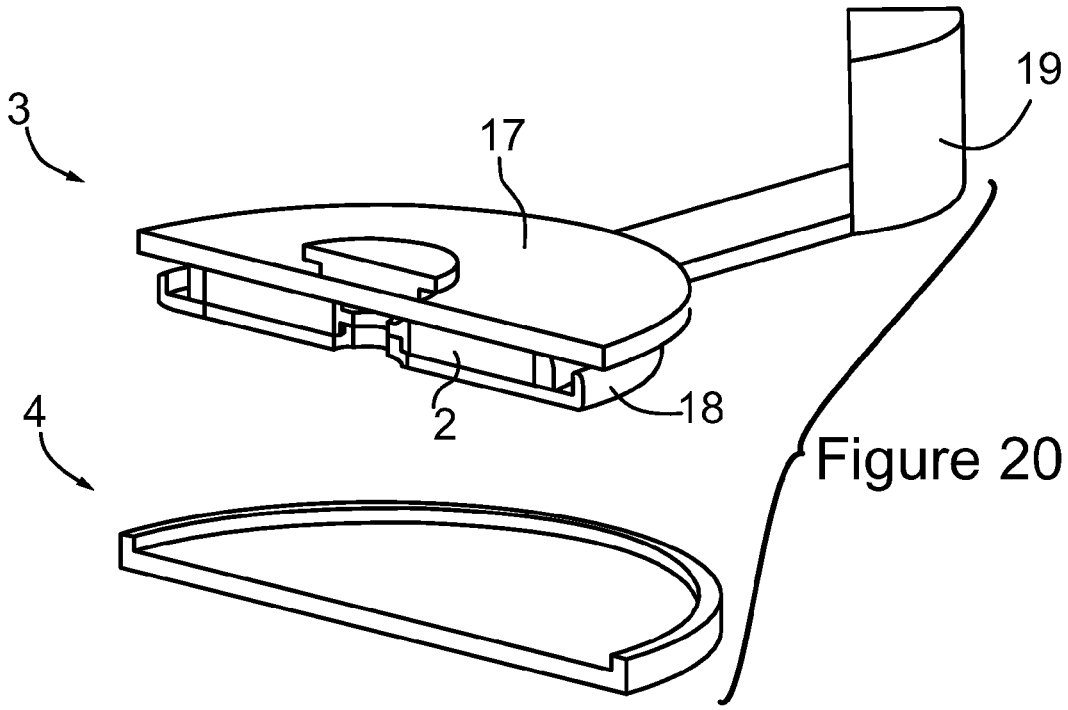
FIG. 20 shows the embodiment of FIG. 19 with the lever having been actuated, the magnets destructively interfering, and the shielded magnetic attachment apparatus in the disengaged configuration.

In some embodiments of the invention, the release mechanism 5 may reduce the magnetic force caused by the at least one magnet 2 by having a plurality of magnets 2 and physically rearranging at least one of the plurality of magnets 2. The abstract concept of operation of an exemplary embodiment containing such a release mechanism 5 is shown in FIGS. 17-18. In such embodiments generally in the engaged configuration the magnets 2 are arranged such that the magnetic fields created constructively interfere, and to transition to the disengaged configuration they are arranged such that the magnetic fields created destructively interfere. In the embodiment shown in FIGS. 19-20, release mechanism 5 comprises a first and second rotatable housing 17, 18 both attached to the first casing 3 and rotatable with respect to one another, wherein the first and second rotatable housings 17, 18 each comprise at least one of the plurality of magnets 2. Furthermore, in this embodiment, upon rotating the first and second rotatable housing 17, 18 with respect to one another, the plurality of magnets 2 is transitioned between a configuration where the magnetic fields of the plurality of magnets 2 constructively interfere and a configuration where the magnetic fields of the plurality of magnets 2 destructively interfere. In this manner, when destructive interference occurs, the force keeping the shielded magnetic attachment apparatus 1 in the engaged configuration is reduced, thus allowing a user to move the plurality of magnets 2 away from the second casing 4. The first and second rotatable housings 17, 18 may be rotated with respect to one another using any means available in the art. For example, in the embodiment shown in FIGS. 19-20, a lever 19 is attached to either the first or second rotatable housing 17, 18. Furthermore, the first and second rotatable housing 17, 18 may both be attached to the first casing 3, may both be attached to the second casing 4, or each may be attached to one of the first and second casings 3, 4.

Figure 21:
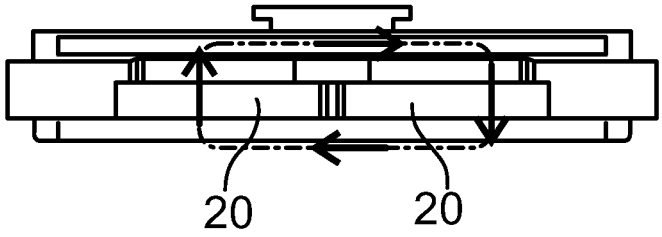
FIG. 21 is a side view of an embodiment wherein the release mechanism creates a low reluctance path, and the low reluctance path comprises a plurality of low reluctance partial shields attached to the first casing, and shows the partial shields not touching one another.
Figure 22:
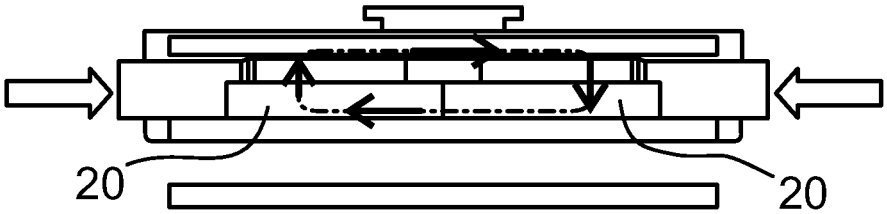
FIG. 22 is a side view of the embodiment shown in FIG. 21 with the partial shields in contact with one another.
Figure 23:
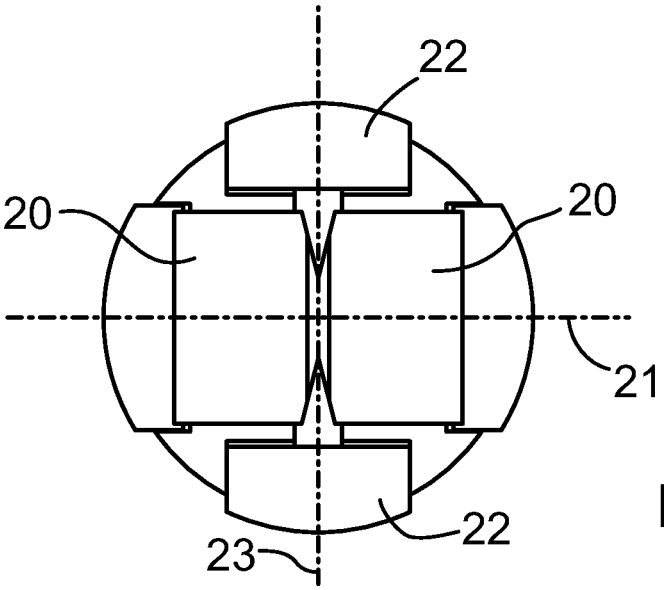
FIG. 23 is a top view of the embodiment shown in FIG. 21.
Figure 24:
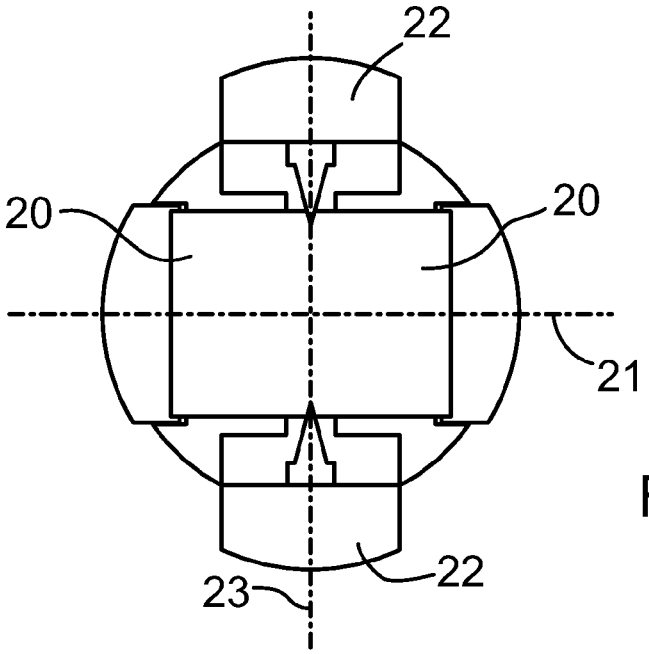
FIG. 24 is a top view of the embodiment shown in FIG. 22.

In another embodiment, the release mechanism creates a low reluctance path blocking the second casing 4 from the at least one magnet 2. By doing so, the magnetic field becomes stronger within the low reluctance path and weakens within the second casing, thus reducing the force keeping the shielded magnetic attachment apparatus 1 in the engaged configuration. In the embodiment shown in the side view of FIGS. 21-22 and top view of FIGS. 23-24, the low reluctance path comprises a plurality of low reluctance partial shields 20 attached to the first or second casing 3, 4 located between the magnet 2 and second casing 4 when the shielded magnetic attachment apparatus 1 is in the engaged configuration. These low reluctance partial shields 20 are normally not in contact with one another, but when they are brought into contact with one another they form the low reluctance path as described earlier. Any suitable method known in the art may be used to bring the partial shields 20 into contact with one another and to keep them from contacting each other when not desired. For example, in the embodiment shown in the side view of FIGS. 21-22 and top view of FIGS. 23-24, the plurality of partial shields 20 is two partial shields 20, the two partial shields 20 are translatable toward and away from one another (the translation direction in this embodiment marked by 21 in the figures), and the release mechanism 5 further comprises two wedged dividers 22 translatable toward and away from one another (the translation direction in this embodiment marked by 23 in the figures) in a direction not parallel to the translatable direction of the partial shields 20. In this embodiment, the wedged dividers 22 normally serve to separate the two partial shields 20 when the shielded magnetic attachment apparatus 1 is in the engaged configuration. That is to say, the wedged dividers 22 are shaped to separate said partial shields 20 when translated towards each other and to maintain this separation when left close to each other, and to allow said partial shields 20 to contact each other when the wedged dividers 22 are translated away from each other. Thus, by pushing the two partial shields 20 towards one another, the wedged dividers 22 move away from one another due to their angled surfaces not parallel to those of the partial shields 20 that they contact, allowing the two partial shields 20 to continue travelling towards one another and eventually to contact and form the low reluctance path. In a further embodiment, the wedged dividers 22 are biased such that when no user-applied force is applied to the partial shields 20, the wedged dividers 22 force the partial shields 20 apart once again, breaking the low reluctance path. As discussed previously, any suitable biasing method known in the art may be used to bias the wedged dividers, for example, a spring or additional magnets. It will be understood that the wedged dividers 22 are not required to move perpendicularly to the partial shields 20 although only such embodiments are shown in the figures.

Figure 25:
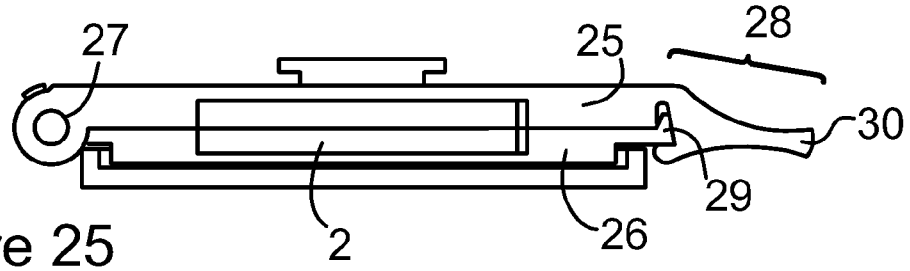
FIG. 25 is an embodiment wherein the first casing comprises a first and second hinged portion rotatably attached to one another by a hinge, and shows the actuation of the hinge to introduce the primary air gap to allow the transition of the shielded magnetic attachment apparatus to the disengaged configuration.
Figure 26:
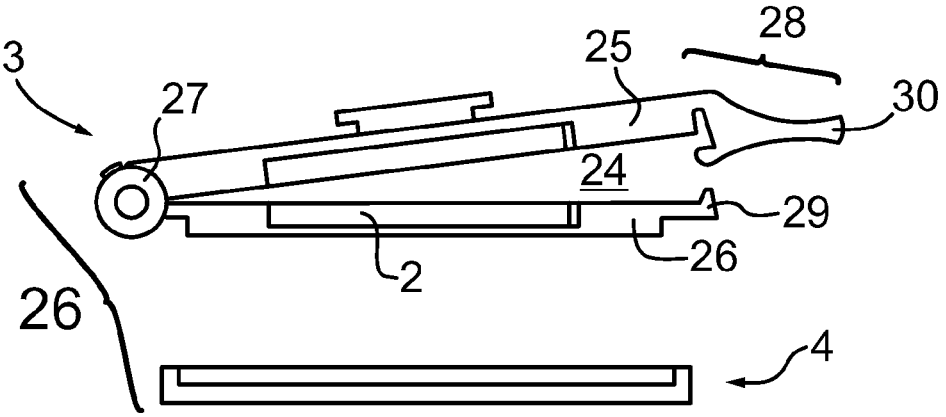
FIG. 26 shows the embodiment of FIG. 25 further comprising a spring assist.
Figure 26A:
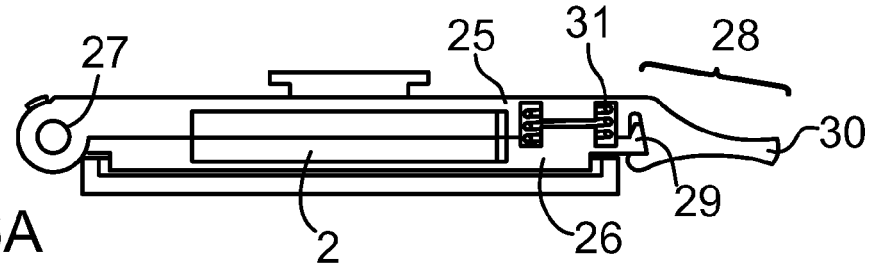
Figure 26B:
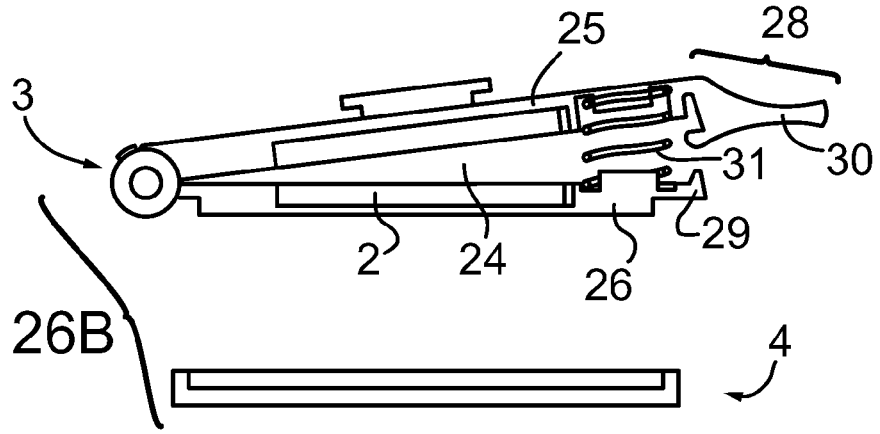

In another embodiment, the release mechanism 5 comprises a primary gap generation mechanism for introducing a primary air gap 24 within the first casing 3 which reduces the magnetic force between the second casing 4 and the at least one magnet 2. The introduction of this primary air gap 24 allows the at least one magnet 2 and first casing 3 to then be pulled away from the second casing 4. As shown in FIGS. 25-26, the first casing 3 may comprise a first and second hinged portion 25, 26 rotatably attached to one another by a hinge 27, wherein the primary gap generation mechanism comprises a mechanism for actuating the hinge 27. The second portion 26 of the first casing is non-ferromagnetic. In some such embodiments, the mechanism for actuating the hinge 27 includes a lock 28 such that it does not inadvertently actuate and introduce the primary air gap 24 in the first casing 3. For example and as shown in FIGS. 25-26, the lock 28 may comprise a protrusion 29 attached to the second hinged portion and a lever 30 bendably attached to the first hinged portion 25 and comprising a hole shaped to accept the protrusion 29. In this manner, when the protrusion 29 rests in the hole in the lever 30, the hinge 27 cannot be actuated. The lever 30 may be bent such that the protrusion 29 comes out of the hole, allowing the lever 30 to freely actuate the hinge 27. Embodiments comprising a lock 28 may also optionally comprise a spring assist 31 which reduces the effort of a user attempting to actuate the hinge 27 and introduce the primary air gap 24. In such embodiments, the spring assist 31 stores energy by extending or compressing and is kept in this position by the lock 28, whereupon release of the lock 28 the energy is released as the spring assist 31 relaxes and provides a force assisting a user actuating the hinge 27.

Although in the illustrations and prior discussion the at least one magnet 2 is primarily attached to the first casing 3, one or more magnets 2 may be located in the second casing 4. For example, the second casing 4 may comprise at least one magnet 2 which serves to strengthen the force that keeps the shielded magnetic attachment apparatus 1 in the engaged configuration.

Furthermore, although the spring assist 31 is shown in the illustrations primarily with embodiments having first and second hinged portions 25, 26, any embodiment may comprise a spring assist 31 for reducing the user-applied force necessary to transition the shielded magnetic attachment apparatus 1 from the engaged configuration to the disengaged configuration. For example, in some embodiments, one of the first and second casings 3, 4 further comprise a spring assist 31 which stores energy when the shielded magnetic attachment apparatus 1 is in the engaged configuration, and the energy is released upon transition to the disengaged configuration thereby assisting the transition. The spring assist 31 may be any type of spring known in the art; for instance, in non-limiting examples, it may be simply a linear spring which is compressed and provides a separating force between the first and second casings 3, 4, or it may be a rotational spring that provides a torque between a screw 16 and threaded bore 15.

Figure 27A:
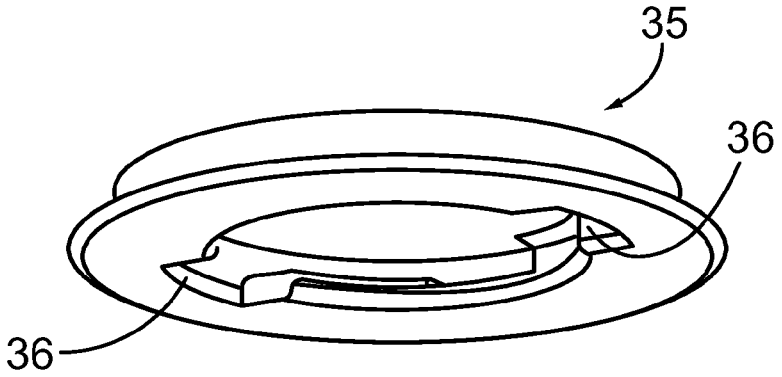
FIG. 27 is an embodiment wherein the connector comprises a cylindrical protrusion having tabs and a spring-loaded plunger, and wherein the corresponding connector comprises a hole shaped to accept the connector.
Figure 27B:
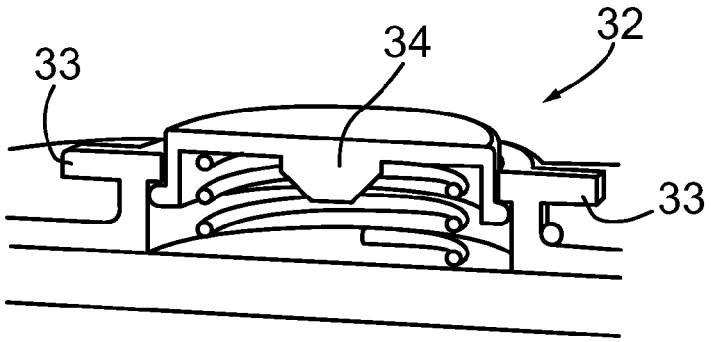
Figure 28A:
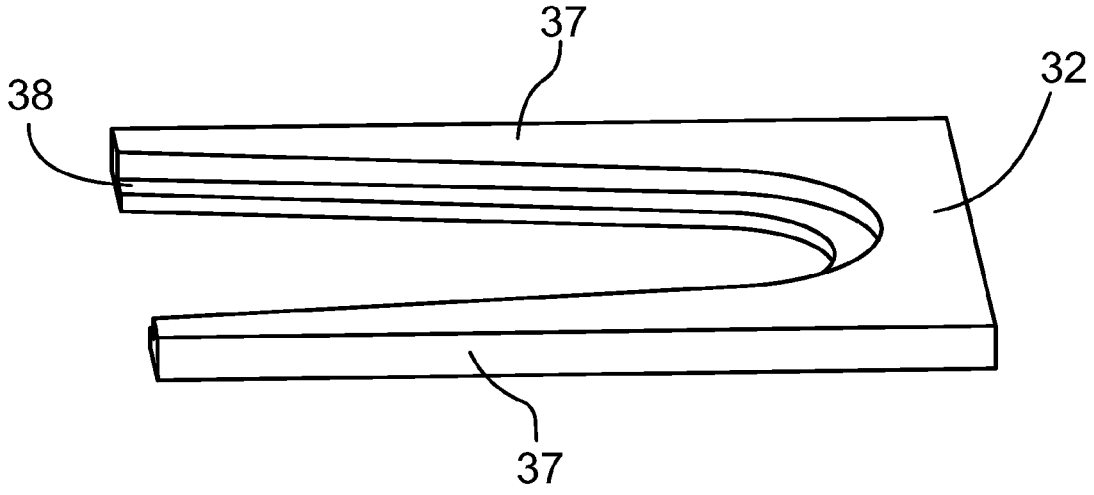
FIG. 28 is an embodiment wherein the connector comprises two arms each having a channel, wherein the arms are connected to one another at one end and the channels at that end merge together in a continuous manner, and wherein the corresponding connector comprises a rim shaped to slide within the channels.
Figure 28B:
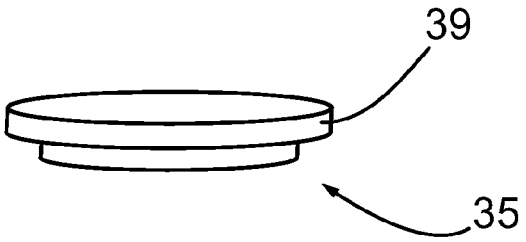

The payload 6 may be connected to the shielded magnetic attachment apparatus 1 in a number of ways. For example, in the embodiment shown in FIG. 27, a connector 32 comprises a cylindrical protrusion having tabs 33 and a spring-loaded plunger 34. The corresponding connector 35 which is attached to or forms part of the payload 6 comprises a cylindrical hole with two tab cut-outs 36 and an inner rim. Thereby, when the corresponding connector 35 is slid over top of the connector 32 such that the tabs 33 match up with the tab cut-outs 36, and the corresponding connector 35 is subsequently rotated relative to the connector 32, the tabs 33 slide under the rim and lock the payload 6 to the connector 32. When this occurs, the spring of the spring-loaded plunger 34 is compressed and thus pushes up against the inside of the corresponding connector 35, thus creating a frictional resistance which stops the corresponding connector 35 from rotating and falling off of the connector 32 unintentionally. In the embodiment shown in FIG. 28, the connector 32 comprises two arms 37 each having a channel 38, wherein the arms 37 are connected to one another at one end and the channels 38 at that end merge together in a continuous manner. The corresponding connector 35 which is attached to or forms part of the payload 6 comprises a rim 39 which is shaped to slide within the channels 38 until it butts up against the end where the arms 37 are connected. In the embodiment shown herein the corresponding connector 35 and is shown as a round disc however it could be any shape with a rim 39 or other arm extending outwardly from the connector 35 on each side thereof. Further, the payload 6 may be connected permanently to the shielded magnetic attachment apparatus 1. Alternatively connector 32 may be attached to or forms part of the payload.

It will be appreciated by those skilled in the art that in all of the embodiments described above that either the connector 32 or the corresponding connector 35 may be connected to the payload 6.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A shielded magnetic attachment apparatus having engaged and disengaged configurations, comprising:

at least one magnet, a first casing comprising ferromagnetic material attached to one side of the at least one magnet and the first casing having a first and second portion and wherein the second portion of the first casing is on another side of the at least one magnet and wherein the second portion of the first casing is non-ferromagnetic, a second casing comprising ferromagnetic material operably magnetically attachable to the at least one magnet, and a release mechanism attached to either the first or second casing for transitioning the shielded magnetic attachment apparatus from the engaged to the disengaged configuration, wherein the shielded magnetic attachment apparatus is in the engaged configuration when the at least one magnet provides a magnetic force which acts to keep the shielded magnetic attachment apparatus in the engaged configuration, and the shielded magnetic attachment apparatus is in the disengaged configuration when the second portion of the first casing is spaced from the at least one magnet such that there is an air gap between the second portion of the first casing and the at least one magnet.

2. The apparatus according to claim 1 wherein said first casing is attached to said at least one magnet such that when said shielded magnetic attachment apparatus is in said engaged configuration, said ferromagnetic material comprising said first and second casings form a substantially closed magnetic circuit around said at least one magnet.

3. The apparatus according to claim 1 wherein said first casing is attached to said at least one magnet such that when said shielded magnetic attachment apparatus is in said engaged configuration, said ferromagnetic material in said first and second casings form a substantially closed chamber around said at least one magnet.

4. The apparatus according to claim 1 wherein said release mechanism is a mechanism for increasing a distance between said second casing and said magnet.

5. The apparatus according to claim 1 wherein said release mechanism comprises at least one button translatable along a push axis and capable of operably transferring a force applied along said push axis, and a force transfer mechanism for transferring the force applied along the push axis to said at least one magnet in a direction away from said second casing.

6. The apparatus according to claim 5 wherein said at least one button comprises an angled surface, said force transfer mechanism comprises a corresponding angled surface located on said first casing and operably attached to said at least one magnet, wherein said angled surface and said corresponding angled surface are in contact and, upon a pushing force being applied to said button, slide with respect to one another thereby pushing the at least one magnet away from said second casing.

7. The apparatus according to claim 1 wherein said release mechanism comprises a rotatable cam.

8. The apparatus according to claim 7 wherein said rotatable cam comprises a rounded oblong plate, and wherein a lever is affixed to said rotatable cam such that a rotation of the lever causes a corresponding rotation of said rotatable cam.

9. The apparatus according to claim 1 wherein said release mechanism comprises a screw and threaded bore.

10. The apparatus according to claim 9 wherein said screw and said threaded bore are both located within said first casing or are both located within said second casing.

11. The apparatus according to claim 9 wherein one or both of said screw and said threaded bore are biased and return to a rest state when no user-applied torque is applied to said screw or said threaded bore.

12. The apparatus according to claim 1 wherein said at least one magnet is a plurality of magnets, and said release mechanism is a mechanism for physically rearranging at least one of the plurality of magnets.

13. The apparatus according to claim 12 wherein said plurality of magnets create a plurality of magnetic fields, said magnetic fields constructively interfere when said shielded magnetic attachment apparatus is in the engaged configuration, and said release mechanism is adapted to physically rearrange at least one of the plurality of magnets to cause said magnetic fields to destructively interfere.

14. The apparatus according to claim 12 wherein said release mechanism comprises a first and second rotatable housing attached to one of said first and second casing and rotatable with respect to one another, said first and second rotatable housings each comprising at least one of said plurality of magnets.

15. The apparatus according to claim 14 wherein said release mechanism comprises a lever attached to either the first or second rotatable housing.

16. The apparatus according to claim 1 wherein said at least one magnet creates a magnetic field, and wherein said release mechanism is a mechanism for creating a low reluctance path such that the magnetic field weakens within said second casing.

17. The apparatus according to claim 16 wherein said low reluctance path comprises a plurality of partial shields attached to said first or second casing in a manner such that they are translatable toward and away from one another.

18. The apparatus according to claim 17 wherein said plurality of partial shields is two partial shields, said release mechanism further comprises two wedged dividers attached to the first or second casing and translatable toward and away from one another, and wherein the wedged dividers are adapted to separate said partial shields when translated towards each other, and to allow said partial shields to contact each other when translated away from each other.

19. The apparatus according to claim 18 wherein said wedged dividers are shaped such that when a user-applied force pushes said partial shields towards each other said wedged dividers translate away from each other, and biased such that when no user-applied force is applied to said partial shields, the wedged dividers force said partial shields apart.

20. The apparatus according to claim 1 wherein said release mechanism has open and closed positions, wherein in the closed position said release mechanism prevents sliding motions of said first casing with respect to said second casing, and wherein in the open position said release mechanism allows sliding motions of said first casing with respect to said second casing, thereby allowing the shielded magnetic attachment apparatus to transition from said engaged configuration to said disengaged configuration.

21. The apparatus according to claim 1 wherein said release mechanism comprises a translatable gate attached to said first casing having an open and a closed position and being movable therebetween.

22. The apparatus according to claim 21 wherein said translatable gate is spring-loaded and moves to said closed position when no user-applied force is applied to said translatable gate.

23. The apparatus according to claim 1 wherein said release mechanism comprises a primary gap generation mechanism for introducing a primary air gap within said first casing.

24. The apparatus according to claim 23 wherein said first casing comprises a first and second hinged portion rotatably attached to one another by a hinge, wherein said primary gap generation mechanism comprises a mechanism for actuating said hinge.

25. The apparatus according to claim 24 wherein said mechanism for actuating said hinge comprises a lock having a locked and unlocked configuration, wherein said lock prevents actuation of said hinge in said locked configuration and allows actuation of said hinge in said unlocked configuration.

26. The apparatus according to claim 25 wherein said lock comprises a protrusion attached to said second hinged portion, and a lever bendably attached to said first hinged portion and comprising a hole shaped to accept said protrusion.

27. The apparatus according to claim 25 wherein said first casing further comprises a spring assist, wherein said spring assist stores energy when said lock is in said locked configuration, and said energy is released upon actuation of said hinge thereby assisting actuation of said hinge.

28. The apparatus according to claim 1 further comprising a connector for attaching a payload.

29. The apparatus according to claim 28 wherein said connector comprises a protrusion attached to said first casing and at least one tab extending outwardly from said protrusion.

30. The apparatus according to claim 29 wherein said protrusion further comprises a spring-loaded plunger.

31. The apparatus according to claim 28 wherein said connector comprises a plurality of arms each having a channel.

32. The apparatus according to claim 31 wherein said plurality of arms is two arms connected to each other at one end such that the two said channels merge in a continuous manner.

33. The apparatus according to claim 1 wherein said ferromagnetic material is one or combination of mu metal, steel, nickel, ferrite, electrical steel, permalloy, and iron.

34. The apparatus according to claim 1 wherein said ferromagnetic material is an 80% nickel-20% iron alloy.

35. The apparatus according to claim 1 wherein said at least one magnet comprises one or combination of rare earth magnets, ferrite magnets, ceramic magnets, samarium cobalt magnets, neodymium iron boron magnets, and injection molded magnets.

36. A shielded magnet attachment apparatus as claimed in claim 1 wherein in the engaged configuration the second portion of the first casing is between the at least one magnet and the second casing.

37. A shielded magnetic attachment apparatus having engaged and disengaged configurations, comprising:

at least one magnet, a first casing comprising ferromagnetic material attached to one side of the at least one magnet, a second casing comprising ferromagnetic material operably magnetically attachable to the at least one magnet, and a rotatable cam release mechanism attached to either the first or second casing for transitioning the shielded magnetic attachment apparatus from the engaged to the disengaged configuration, wherein the shielded magnetic attachment apparatus is in the engaged configuration when the at least one magnet provides a magnetic force which acts to keep the shielded magnetic attachment apparatus in the engaged configuration, and the shielded magnetic attachment apparatus is in the disengaged configuration when not in the engaged position and wherein said rotatable cam release mechanism is biased and returns to a rest state when no user-applied torque is applied to said rotatable cam release mechanism.

38. The apparatus according to claim 37 wherein one of said first and second casings comprises two separable portions, said rotatable cam release mechanism is attached to one of said separable portions, and rotation of said rotatable cam causes a distance between said separable portions to increase.

39. A shielded magnetic attachment apparatus having engaged and disengaged configurations, comprising:

at least one magnet, a first casing comprising ferromagnetic material attached to one side of the at least one magnet, a second casing comprising ferromagnetic material operably magnetically attachable to the at least one magnet, and a release mechanism attached to either the first or second casing for transitioning the shielded magnetic attachment apparatus from the engaged to the disengaged configuration, wherein the shielded magnetic attachment apparatus is in the engaged configuration when the at least one magnet provides a magnetic force which acts to keep the shielded magnetic attachment apparatus in the engaged configuration, and the shielded magnetic attachment apparatus is in the disengaged configuration when not in the engaged position and wherein one of said first casing and said second casing further comprises a spring assist, wherein said spring assist stores energy when said shielded magnetic attachment apparatus is in said engaged configuration, and said energy is released upon transition of said shielded magnetic attachment apparatus to said disengaged configuration thereby assisting transition of said shielded magnetic attachment apparatus.

* * * * *